US006363702B2

(12) United States Patent
Langen

(10) Patent No.: US 6,363,702 B2
(45) Date of Patent: Apr. 2, 2002

(54) TRANSPORTATION AND STORAGE SYSTEM FOR RECTANGULAR SPINNING CANS

(76) Inventor: Evelyn Langen, Am Kolbusch 44, D-41179 Mönchengladbach (DE)

( * ) Notice: Subject to any disclaimer, the term of this patent is extended or adjusted under 35 U.S.C. 154(b) by 0 days.

(21) Appl. No.: 09/827,215

(22) Filed: Apr. 5, 2001

(30) Foreign Application Priority Data

Apr. 12, 2000 (DE) ..... 100 18 184

(51) Int. Cl.[7] ..... D01H 13/26
(52) U.S. Cl. ..... 57/1; 57/281; 19/159 A
(58) Field of Search ..... 57/1, 90, 268, 57/281; 19/65 A, 159 A, 159 R; 198/346.1, 346.2, 427, 430, 433, 465.1; 414/222.01, 222.13, 416, 811

(56) References Cited

U.S. PATENT DOCUMENTS 3,884,026 A * 5/1975 Yoshizawa et al. ..... 19/159 A
5,276,947 A * 1/1994 Fritschi et al. ..... 19/159 A
5,632,138 A * 5/1997 Liedgens ..... 57/281
5,729,868 A * 3/1998 Liedgens et al. ..... 19/159 A
5,974,630 A * 11/1999 Langen ..... 19/159 A
5,992,136 A * 11/1999 Langen ..... 57/281
6,250,059 B1 * 6/2001 Teich ..... 57/281

FOREIGN PATENT DOCUMENTS

| | | |
|---|---|---|
| DE | 40 18 088 | 1/1991 |
| DE | 40 15 377 | 11/1991 |
| DE | 197 13 859 | 10/1998 |
| EP | 0 869 206 | 3/1998 |

* cited by examiner

*Primary Examiner*—John J. Calvert
*Assistant Examiner*—Gary L. Welch
(74) *Attorney, Agent, or Firm*—Collard & Roe, P.C.

(57) ABSTRACT

A transportation and storage system for spinning machines with transfer storage places associated with each spinning machine. With an automatic supply of the spinning machine via transporters as the connecting means between the transfer storage place and the spinning machine, the goal is to manage exclusively with straight guides. The spinning cans are supplied to the transfer storage place with the same spatial orientation with which they are emptied in the spinning machine.

3 Claims, 1 Drawing Sheet

TRANSPORTATION AND STORAGE SYSTEM FOR RECTANGULAR SPINNING CANS

BACKGROUND OF THE INVENTION

1. Field of the Invention

The invention relates to a transportation and storage system for rectangular spinning cans, comprising can storage places and can transporters between first machines that fill empty spinning cans, and second machines that each empty full spinning cans along a processing (spinning) line or along the longitudinal sides of the processing machines. Each first machine has a can line storage place with storage places directly associated with the machine for empty cans to be placed next to each other in an orderly, i.e. oriented arrangement. There are also storage places for full cans that have to be placed next to each other in an orderly, i.e. oriented arrangement.

2. The Prior Art

In the textile industry, ribbons of fiber material (the preliminary yarn) are transported to stretching machines as well as to flyers and spinning machines via so-called spinning cans. After the cans have been filled or have run empty, each of the spinning cans has to be replaced by a new empty or filled can, respectively.

In conjunction with modern spinning machines, the pre-yarn is supplied to the machines in so-called rectangular cans having a standard size in the form of a square stone. The largest side of the rectangle measured parallel with the bottom of the can is referred to as the length of the can. The length of the narrow side of the rectangle measured parallel with the bottom of the can is referred to as the width of the can. Rectangular spinning cans are oriented on the spinning machine in a defined way, i.e. the cans are specifically positioned along each processing line underneath the spinning points or spindles of the spinning machine, with the wide sides of the rectangle facing each other. The two longitudinal ends of the individual can are not equal in most cases, so that the orientation on the spinning machine comprises the alignment of the can with respect to one of the longitudinal ends of the can as well.

When the can is in the take-off (or processing) position properly orientated as required, the pre-yarn can be pulled from the can in each spinning site. Once the can has run empty, it is replaced by a full can. So-called can transporters or can changer carriages are employed for transporting the can to and away from the machines. Such a carriage runs along a driving track extending along a row of the working positions or spindles of the spinning machine. Such working positions or spindles are arranged in the straight line next to each other in a processing line and thus along a driving track extending along the row of cans to be serviced, between two rows of spinning machines in most cases.

In a large spinning mill, which has a multitude of stretching machines with flyers and/or spinning machines arranged downstream, it is preferred that at least the automatically operating spinning machines produce without interruption. This requires that the spinning machines be continually supplied with adequate amounts of yarn stock, i.e., full cans, and that the empty spinning cans be transported off.

The degree of automation in the preliminary works of the plant upstream, which involves opening a fiber bale supplied as the raw material, has not as yet reached the degree of automation found in the actual spinning mill. Because of this, the preliminary material is often prepared and stored with excess capacity in such large quantities that spinning can continue without any interruption in the spinning mill even in the event of machine shutdown in the preliminary works.

A transportation and storage system for rectangular spinning cans that is being successfully employed as described above is described in European Patent No. EP 08 69 206 A2. This patent describes providing an automatic supply between stretching machines and spinning machines by interconnecting an additional can conveyance and storage system between the machines of the first group (stretching machines) and the machines of the second group (spinning machines).

According to EP 08 69 206 A2 cited above, the rectangular spinning cans are handled with the same alignment by which they are oriented when leaving the stretching machine, and are passed with such alignment through the major part of the storage system until they reach the specific can transporter that delivers the spinning can (empty or full can) directly to the spinning point, or spinning spindle. This means that can transporters which orient the individual spinning can according to the requirements in the respective spinning site are required on the spinning machine. In the prior art, the can transporter drives up to the spinning cans stored in the last storage place, receives such cans (not in a turned-around position), and then drives around a curve, for example a 90° curve, in order to turn the can and to orient it correctly in this way for the spindle of the spinning machine.

Such redirection (or reversing) of the individual can transporter can be safely carried out in an automatic operation only if the transporter is equipped with the required and costly guiding means. Furthermore, in very large spinning mills, a separate can transporter is needed for each side of a spinning machine. These transporter vehicles may obstruct each other at the receiving and delivery points.

SUMMARY OF THE INVENTION

It is therefore an object of the invention to improve the transportation and storage system in such a way that only guides extending with a straight alignment are required along each processing line or longitudinal side of the spinning machines between a transfer storage place and the respective spinning sites, or spindles. Where the cans are supplied to the spinning machine automatically via rail-borne vehicles to connect the transfer storage place and the spinning site, or spindle, the goal is to exclusively use straight rails.

The invention comprises a transportation and storage system for rectangular spinning cans, comprising can storage places and can transporters between first machines filling spinning empty cans, and second machines each emptying full spinning cans, along a processing line or longitudinal side of the machine. Each first machine has a can line storage place associated with it, with storage places for empty cans to be placed next to each other in an oriented manner, and storage places for full cans to be placed next to each other in an oriented manner as well. The second machine has for each of its processing lines a can transfer storage place in which at least the full cans are spatially oriented in the same way as the cans being instantaneously processed in the respective processing line itself.

A distinction is made in this conjunction between first machines and second machines. In connection with the jet or ring spinning mill, the first machines may be stretching machines or flyers, and the second machines may be flyers or spinning machines. In conjunction with the open-end spinning mill (OE spinning mill), the first machines generally are stretching machines and the second machines are OE spinning machines.

According to the invention, the spinning cans (at least the full cans) are supplied to the can transfer storage place already with the spatial orientation with which they are emptied on the spinning machine. The individual jet, ring or OE spinning machine etc. should have for each of its longitudinal sides a transfer storage place with a supply that is at least adequate for a temporary shutdown of the preliminary works. For example, at least the full cans—and preferably also the empty cans, so that the further operation along the route via the stretching plant, etc., will not require any re-orientation work—are spatially aligned along the respective side of the spinning machine (or processing line) itself like instantaneously processed cans.

The transfer storage place associated with each spinning machine must accommodate sufficient cans that temporary automatic operation is possible in any case, without having to supply the storage place with fresh full cans. Regarding the aforementioned EP 08 69 206A2, the invention means that the storage place provided according to this document between the first and the second machines is basically cancelled and shared out to the transfer storage places of the spinning machines.

Because in the present invention the can transporter vehicles operating along the respective spinning machine receive the cans already with the correct orientation for the actual spinning process, the vehicles do not have to travel through curves but rather can drive along straight guides, for example on mechanical guides, inductive guides or laser selection guides. In other words, the can transporter associated with a spinning machine only deposits the individual cans by parallel displacement at the spinning site (or spindle) with exactly the same orientation with which it has received such cans in the transfer storage place.

If the transfer storage place, where the cans are already spatially oriented, has to have an adequate amount of cans for a longer shutdown in the preliminary works, e.g. for a night shift or a weekend, it can be supplemented by an additional storage place with substantially the same orientation of the cans. For this purpose, there is a night shift can storage place located on the opposite side of the respective straight guide, where the cans also have the same spatial orientation as required along the processing line. The term "night shift" relates in general not only to a temporary shutdown of the preliminary works, but also, for example to the bridging of a weekend.

According to the invention, transfer storage places as well as night shift storage places, if necessary, where the spinning cans are already spatially aligned, are allocated to each spinning machine, and the cans are then delivered to the spinning sites (or spindles) with this orientation, preferably via can transporters. While according to the aforementioned EP 08 69 206 A2, the cans are correctly oriented or turned between the last storage place located upstream of the spinning site, and the spinning site, according to the present invention, the cans are turned already while or before they are inserted in the transfer storage place, possibly immediately after they have been deposited in the can deposit of the stretching machine or a flyer, if necessary.

When a spinning machine is supplied as defined by the invention, a can transporter is associated with each of the two longitudinal sides or processing lines of the machine and thus also of the associated can storage place. Overall, therefore, the machine is serviced by two can transporters. The two can transporters of the spinning machine may operate independently of one another because each of the two transporters has its own delivery point in its own transfer storage place (preferably for full and empty cans). The conveyance system is simplified in this way. No mutual hampering of the can transporters can occur. The transporters; do not have to travel through curves; mechanical straight guides can be embedded in the floor, so that the guides will not interfere with any cross traffic like a groove imbedded in the floor. The use of one can transporter on each side of the spinning machine means an increase in the useful effect of the individual can transporter because the maximum (empty) driving distance of a can transporter can amount to only the length of a machine at the most.

The can transporters can be realized in different ways. According to a first variation, the individual can transporter can have a plurality of can places, for a total of two places for empty and full cans. In addition, a place can be provided for a person traveling along on the transporter (possibly with an additional manual control). The possibility for transport of a person is highly desirable in large spinning mills because operators often have to cover enormous distances in a time-consuming way to eliminate machine defects.

According to another variation, only one can place is provided on the individual transporter. This vehicle will then have to separately travel back and forth for each can. However, vehicles of this type require substantially less expenditure than transporters with two or more places for different cans that are transported at the same time.

BRIEF DESCRIPTION OF THE DRAWING

Other objects and features of the present invention will become apparent from the following detailed description considered in connection with the accompanying drawing. It is to be understood, however, that the drawing is designed as an illustration only and not as a definition of the limits of the invention.

DETAILED DESCRIPTION OF THE PREFERRED EMBODIMENT

Figure 1:
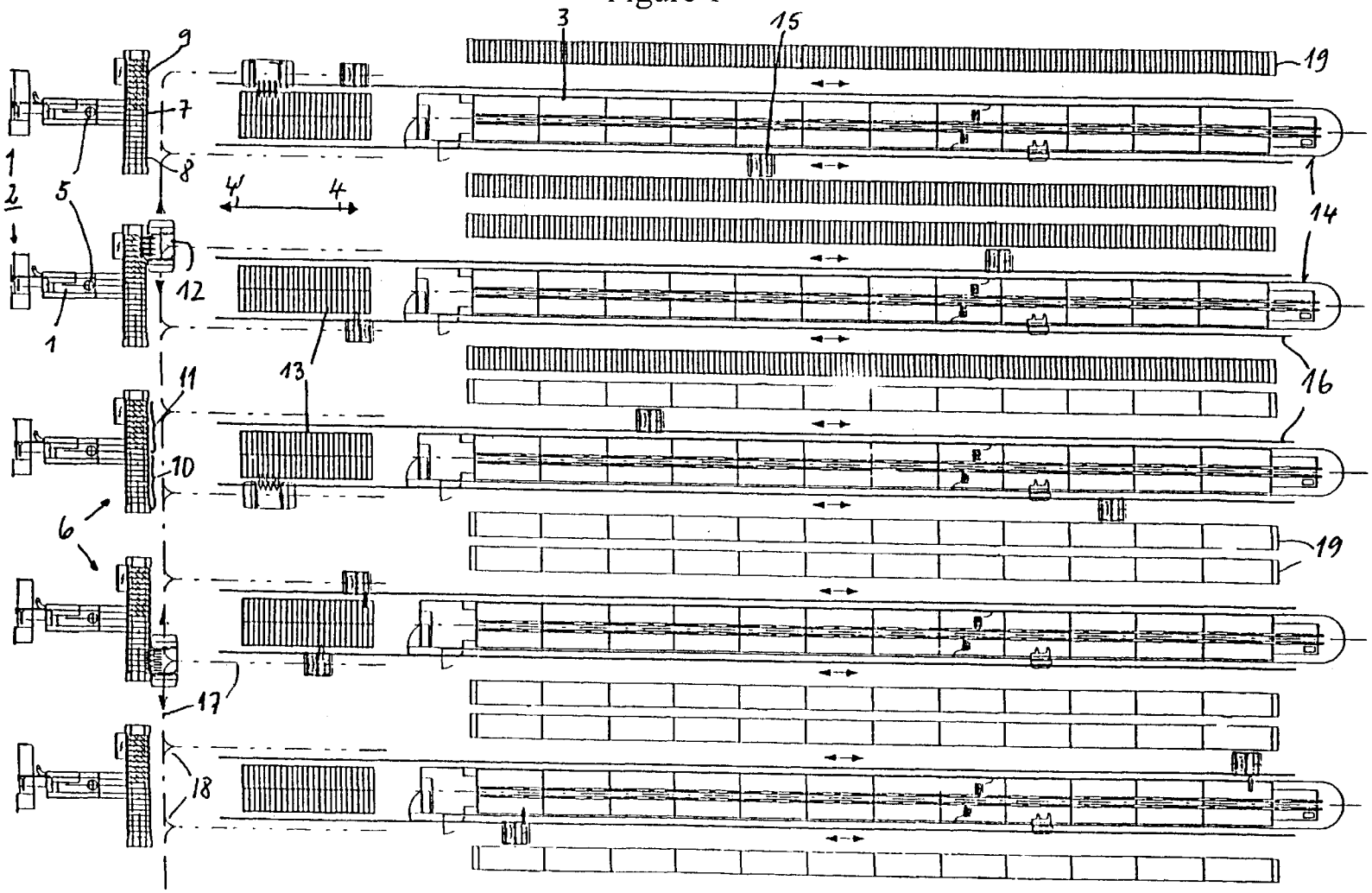
FIG. 1 shows a transportation and storage system comprising a can transporter on each side of the spinning machine on a straight guide.

Referring now in detail to the drawing, there is shown by a top view the rectangular spinning cans 1, which are transported back and forth between the conventionally operating stretching machines 2 and the conventionally operating spinning machines 3, in particular open-end or OE spinning machines. In the direction of the arrow 4, full cans are transported from the stretching machines 2 (first machines) to the spinning machines 3 (second machines). In the direction of the arrow 4', empty cans are conveyed in the reverse direction. The mutual spatial association of the spinning and stretching machines according to the drawing is not important to the invention; the stretching machines may be oriented in an entirely different way or even may be installed in a different room.

The individual can 1 is filled in each can filling position 5 of the stretching machines 2. Once a can 1 has been filled, it is transported to the so-called line storage place 6. Storage place 6 should have at least one vacant place 7 for the full can, but also contain at least one empty can 8, so that after a full can 9 that has just been filled has been transported away, an empty can 8 can be immediately moved from the storage place 6 into the can filling position 5, or as quickly as possible. It is preferred that in the line storage place 6, the empty cans 8 and the full cans 9 each are positioned or collected in the groups 10 and 11 arranged next to one another.

In the present embodiment, a can conveyor, or so-called line conveyor 12 transports and delivers the empty cans 8 to line storage place 6, and transports away the full cans 9 collected in line storage place 6. Line conveyor 12 should have a can holding capacity adequate for simultaneously picking up a group 10 and group 11 of empty and, respectively, full cans each. Such a group 10 or 11 of cans may comprise four cans.

According to the invention, line conveyor 12 not only brings up the empty cans 8 and further transports full cans 9, but also provides individual cans with the spatial orientation that is correct for the respective spinning site, and then delivers such cans with the correct orientation to a transfer storage place 13 of the spinning machine 3. Line conveyor 12 turns the individual cans each by 90° around the vertical axis of the can. What is achieved with this arrangement (where the stretching machines and the spinning machines are lined up in pairs along a straight line) is that empty cans 8 coming from spinning machine 3 to stretching machine 2 will arrive in line storage place 6 with the correct orientation, and full cans 9 will be placed in a transfer storage place 13 already provided with the correct spatial orientation for spinning machine 3 or for each side of it.

In each transfer storage place 13 associated with a spinning machine or with each longitudinal side of each spinning machine, at least the full cans are spatially oriented in the same way as in the spinning or working site of the spinning machine itself. Each of transfer storage places 13 has to be adequately large for each side of the machine so that it can assure the automatic operation of the spinning machines. A can transporter 15 is provided between each transfer storage place 13 and the working positions or spindles of each of spinning machines 3 for each of the longitudinal sides 14 of the spinning machines. Can transporter 15 travels on a straight guide 16 extending along the spinning machine and along the transfer storage place 13. Transporter 15 picks up the empty cans 8 from the spinning sites, transports them into the transfer storage place 13, and replaces them by the full cans 9 that originate from the transfer storage place 13.

The aforementioned line conveyor 12, which is located upstream, travels, for example in rails or in an inductive guide, and runs along the drawn guide lines 17 in a straight line from the storage place 6 to the storage place 6, or it is reversed on the curves 18, and is employed for supplying the transfer storage places 13. It is important that line conveyor 12 is capable of driving both straight from storage place 6 to storage place 6, and also through the curves 18, so that it can provide the spinning cans during transport with the correct orientation and give way to another line conveyor 12.

Night shift can storage places 19 can be associated with each longitudinal side 14 of the machine, which is located on the opposite side with respect to the guide 16. The storage places 19 basically can be viewed as additional storage places or as part of the transfer storage places 13. Also in the night shift storage place 19, the cans have to be arranged with the orientation exactly as the one in the transfer storage place 13, i.e. with the orientation with which they are used in the intended spinning site.

Accordingly, while only a single embodiment of the present invention has been shown and described, it is obvious that many changes and modifications may be made thereunto without departing from the spirit and scope of the invention.

What is claimed is:

1. A transportation and storage system for rectangular spinning cans, comprising:

a can line storage place associated with a first machine that fills spinning empty cans, said can line storage place having storage places for empty cans to be placed next to each other in an oriented manner, and storage places for full cans to be placed next to each other in an oriented manner as well;

a can transfer storage place associated with a second machine for emptying full spinning cans along at least one longitudinal side of said second machine, wherein at least the full spinning cans have a same spatial orientation as cans being instantaneously processed along said longitudinal side;

at least one can transporter disposed between said first and second machines; and a straight guide along each longitudinal side of the second machine for the can transporter to be displaced along said side.

2. The transportation and storage system according to claim 1, wherein said can transfer storage place is parallel to and co-linear with said longitudinal side of the second machine.

3. The transportation and storage system according to claim 1, further comprising a night shift can storage place having cans oriented in the same way as in a spinning site on the longitudinal side of the second machine, said night shift can storage place being disposed on an opposite side of the guide as the respective longitudinal side of the second machine.

* * * * *